US006662811B2

(12) United States Patent
Mugge et al.

(10) Patent No.: US 6,662,811 B2
(45) Date of Patent: Dec. 16, 2003

(54) DEVICE FOR APPLYING AN ADDITIVE TO HAIR

(75) Inventors: Jan Mugge, Drachten (NL); Lippe Van Der Brug, Drachten (NL); Nicolette Gonnie Alice Van Solingen, Groningen (NL); Kok Wah Ma, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 71 days.

(21) Appl. No.: 09/952,181

(22) Filed: Sep. 14, 2001

(65) Prior Publication Data

US 2002/0069889 A1 Jun. 13, 2002

(30) Foreign Application Priority Data

Sep. 15, 2000 (SG) ..... 200005250-6

(51) Int. Cl.[7] ..... A45D 19/16; A45D 20/08; A45D 1/04; A45D 6/06

(52) U.S. Cl. ..... 132/272; 132/230; 132/271; 132/228

(58) Field of Search ..... 132/112, 115, 132/118, 111, 227, 228, 229, 230, 272, 271; 40/184, 190, 186, 270, 277

(56) References Cited

U.S. PATENT DOCUMENTS 2,381,048 A * 8/1945 Habostad ..... 132/112
4,237,822 A * 12/1980 Kaiser, Jr. ..... 119/85
4,899,456 A * 2/1990 Morita et al. ..... 119/83
4,934,855 A * 6/1990 Recchelbacher ..... 401/137
4,936,027 A * 6/1990 Tsuji ..... 34/90
5,494,058 A * 2/1996 Chan ..... 132/228
5,555,899 A 9/1996 Foreman ..... 132/114
5,909,737 A * 6/1999 Ricco ..... 132/116
6,357,449 B1 * 3/2002 Chu et al. ..... 132/112

FOREIGN PATENT DOCUMENTS

| | | | |
|---|---|---|---|
| DE | 857852 C | 12/1952 | |
| DE | 3931111 A1 | 3/1991 | ..... A45D/24/22 |
| EP | 0523460 B1 | 1/1993 | |
| FR | 2277546 | 2/1976 | ..... A45D/24/22 |
| WO | WO9851183 | 11/1998 | ..... A45D/24/22 |

* cited by examiner

*Primary Examiner*—John J. Wilson
*Assistant Examiner*—Robyn Kieu Doan
(74) *Attorney, Agent, or Firm*—Ernestine C. Bartlett

(57) ABSTRACT

In a device (1) for applying an additive to hair comprising a longitudinally extending base part (2) for making contact with the hair during operation, which base part (2) comprises a distribution system (3) for additive, which distribution system (3) has an inlet (4) which is connected to an additive dispenser (5) and has outlets (6) for applying the additive to the hair during operation, a flowpath (7,7') is present between the inlet (4) and each outlet (6), which flow path comprises at least one ramification point (8), said flow paths (7,7') having a substantially identical flow resistance measured from the inlet (4) to each outlet (6). Additive originating from the inlet (4) during operation and following the flow paths (7,7') to each outlet (6) will reach all outlets (6) practically simultaneously, and the additive flow-rate through each outlet is substantially the same. As a result of this, the additive is distributed evenly over the hair by the device (1), which benefits a good hairstyling result.

9 Claims, 7 Drawing Sheets

DEVICE FOR APPLYING AN ADDITIVE TO HAIR

Figure 1:
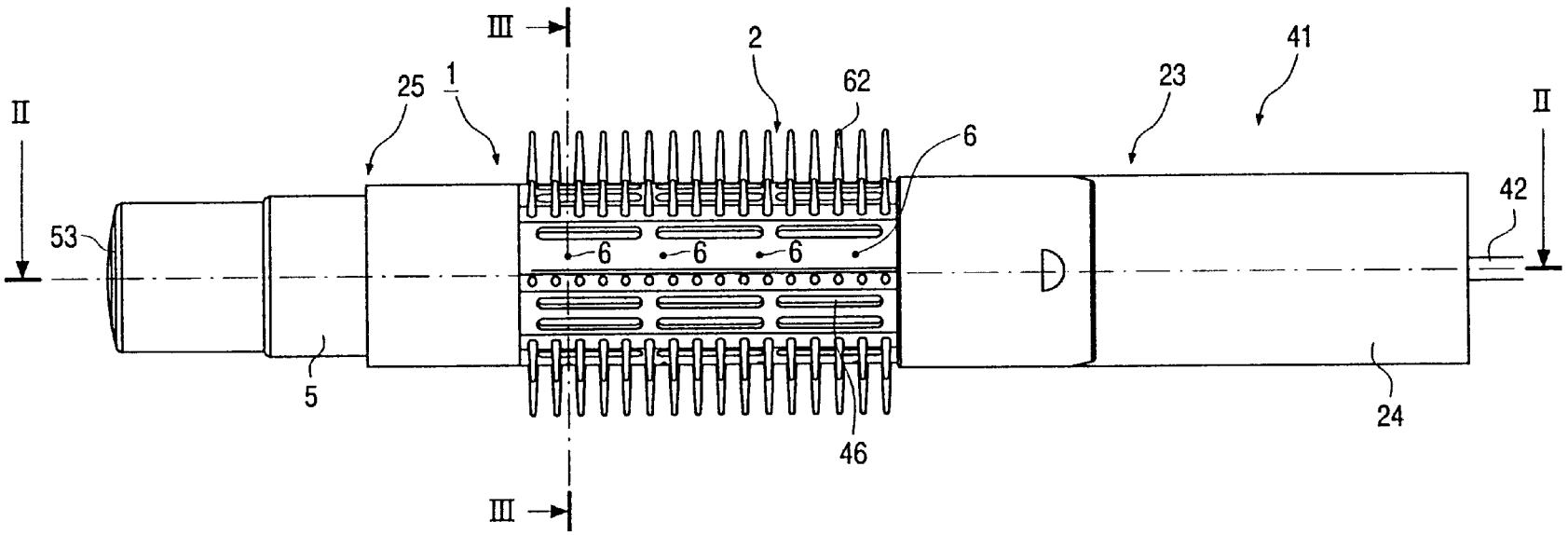

The invention relates to a device for applying an additive to hair, comprising a longitudinally extending base part for making contact with the hair during operation, which base part comprises a distribution system for additive, which distribution system has an inlet which is connected to an additive dispenser and has outlets for applying the additive to the hair during operation.

The invention further relates to an electric hairstyler comprising power supply means and a handle, and comprising a device for applying an additive to hair, which device comprises a longitudinally extending base part for making contact with the hair during operation, which base part comprises a distribution system for additive, which distribution system has an inlet which is connected to an additive dispenser and has outlets for applying the additive to the hair during operation.

A device for applying an additive to hair of the type defined in the opening paragraphs is known from EP 0 523 460 B1. The base part of this known device is formed by a comb body with comb teeth. The comb body and the comb teeth are hollow and thus form the distribution system for the distribution of additive, which in this known device is a hairstyling foam. The inlet is a discharging tube in the hollow comb body, which tube is connected to the additive dispenser comprising a jet operating portion and a container. The outlets of the distribution system, through which the foam is applied to the hair during operation, are formed by apertures in the ends of the hollow comb teeth. By activating a button during operation, foam is forced from the dispenser through the foam-discharging tube and the hollow comb body, through the hollow comb teeth to the apertures in said comb teeth, and thus directed to the hair. A disadvantage of the known device is that the additive, and especially foam, is not distributed evenly over the hair by the device. The even distribution of additive over the hair is important if a good hairstyling result is to be achieved with the device.

It is an object of the invention to provide a device for applying an additive to hair of the type defined in the opening paragraphs which is improved as regards its hairstyling performance.

To achieve this object, a device for applying an additive to hair according to the invention is characterized in that a flow path is present between the inlet and each outlet, which flow path comprises at least one ramification point, said flow paths having a substantially identical flow resistance, measured from the inlet to each outlet. Because of the fact that each flow path has a substantially identical flow resistance from the inlet to the relevant outlet, additive originating from the inlet and following the flow paths to each outlet during operation experiences a substantially equal deceleration along each flow path. The additive thus reaches all outlets practically simultaneously, and the additive flowrate is substantially the same through each outlet. As a result of this, the additive is distributed evenly over the hair, which benefits a good hairstyling result.

An embodiment of a device for applying an additive to hair according to the invention is characterized in that the flow paths each comprise an identical sequence of flow channels and flow channel ramification points, corresponding flow channels of said sequences having identical lengths and cross sections, and corresponding flow channel ramification points of said sequences having an identical number of branches. It is advantageous when the substantially identical flow resistance of the flow path from the inlet to each outlet is obtained in this way, since the flow resistances in the flow paths are identical to a high degree. The construction of the distribution system is thus comparatively simple, which benefits an easy and cost-effective manufacture.

An embodiment of a device for applying an additive to hair according to the invention is characterized in that the flow paths are provided as slots on a cylindrical carrier element which are covered by a cylindrical covering element, and which merge into openings in the covering element. The distribution system is thus composed of only two parts, which parts can be manufactured efficiently in mass production and are easy to assemble. The distribution system can thus be realized in a comparatively simple and cost-effective way. Next to that, the cylindrical covering element serves a double function. On the one hand its inner circumferential area covers the slots forming the flow paths in the distribution system, and on the other hand its outer circumferential area can accommodate additional hairstyling elements such as brush hairs or pins.

It is advantageous when the carrier element and the covering element are detachably connected to each other. The use of an additive, and especially foam, in this device involves a risk of obstruction of the flow paths or the outlets, or both, owing to additive remaining in the distribution system after operation. This remaining additive adversely affects the flow resistances of the flow paths and the even distribution of additive over the hair by the device. By offering the possibility to detach the carrier element and the covering element from each other, both parts can be cleaned individually. Consequently the distribution system can be kept clean and a good hairstyling performance of the device is secured.

An embodiment of a device for applying an additive to hair according to the invention is characterized in that the flow paths are provided as channels provided in a longitudinally extending flat support, which channels extend from the inlet to hollow protuberances, which hollow protuberances extend from a surface of said support to the outlets. Since the flow paths are formed by channels communicating with hollow protuberances, it is prevented that additive leaks away from the flow paths while moving from the inlet to each outlet during operation. It is prevented in this way that additive leaks from the distribution system into other parts of the device, which could damage the operation and the performance of the device.

An embodiment of a device for applying an additive to hair according to the invention is characterized in that the base part has a first end on which a handle is provided and a second end on which the additive dispenser is provided. When a user holds the device by the handle at one end of the base part during operation and brings the base part into contact with the hair, the additive dispenser at the other end of the base part will protrude at least partly from the contacted hair locks. The additive dispenser can thus be easily activated by the user. Next to that, the additive dispenser is thus easily accessible, so that it can be refilled or detached from the device in a simple manner.

According to the invention, an electric hairstyler of the kind mentioned in the opening paragraphs is characterized in that the device for applying an additive is a device according to the invention. The advantages of styling the hair electrically, for example by means of heating elements or air, are enhanced by the advantage of applying additive evenly over the hair. An effective styling and setting of the hair can thus be achieved with a hairstyler according to the invention.

In an electric hairstyler according to the invention comprising a carrier element and a covering element detachably connected to each other, it is advantageous when the carrier element and the covering element are connected to the handle during operation, and are detachable from the handle only while attached to each other. A potentially dangerous situation arises if one of the respective elements should stay attached to the handle after the other part has been detached. A user who wants to clean both elements after use of the hairstyler with additive can clean the one loose part safely with, for example, water. The handle with the power supply means, to which the other part is still attached, should not come into contact with liquids because it could still be plugged in inadvertently. If the carrier element and the covering element can only be detached from the handle when they are attached to each other, the elements can both be cleaned individually only after being detached from the handle containing the electrical components. This benefits the safety of use of the device.

It is advantageous when the covering element comprises a tongue which fits in a slot in the carrier element and which is fastened in said slot by means of the handle as long as the carrier element is connected to the handle. It is only after detaching of both the carrier element and the covering element from the handle that the tongue of the covering element is no longer fixed in the slot in the carrier element by the handle and can be accordingly disengaged from the carrier element.

An embodiment of an electric hairstyler according to the invention is characterized in that the handle comprises a fan unit and the base part comprises air transport channels extending from the handle to air outlets provided in the base part. The styling of hair by means of air, such as blowing hot or cold air or both, is thus combined with the even distribution of additive over the hair, resulting in a hairstyler which offers a good hairstyling performance.

Figure 2:
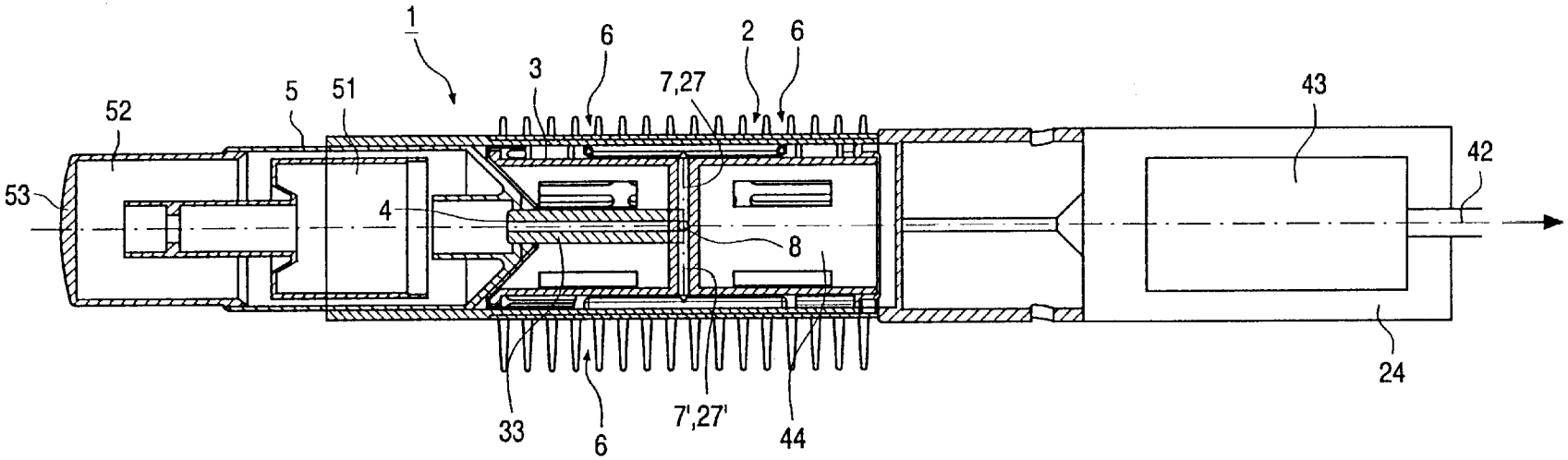
Figure 3:
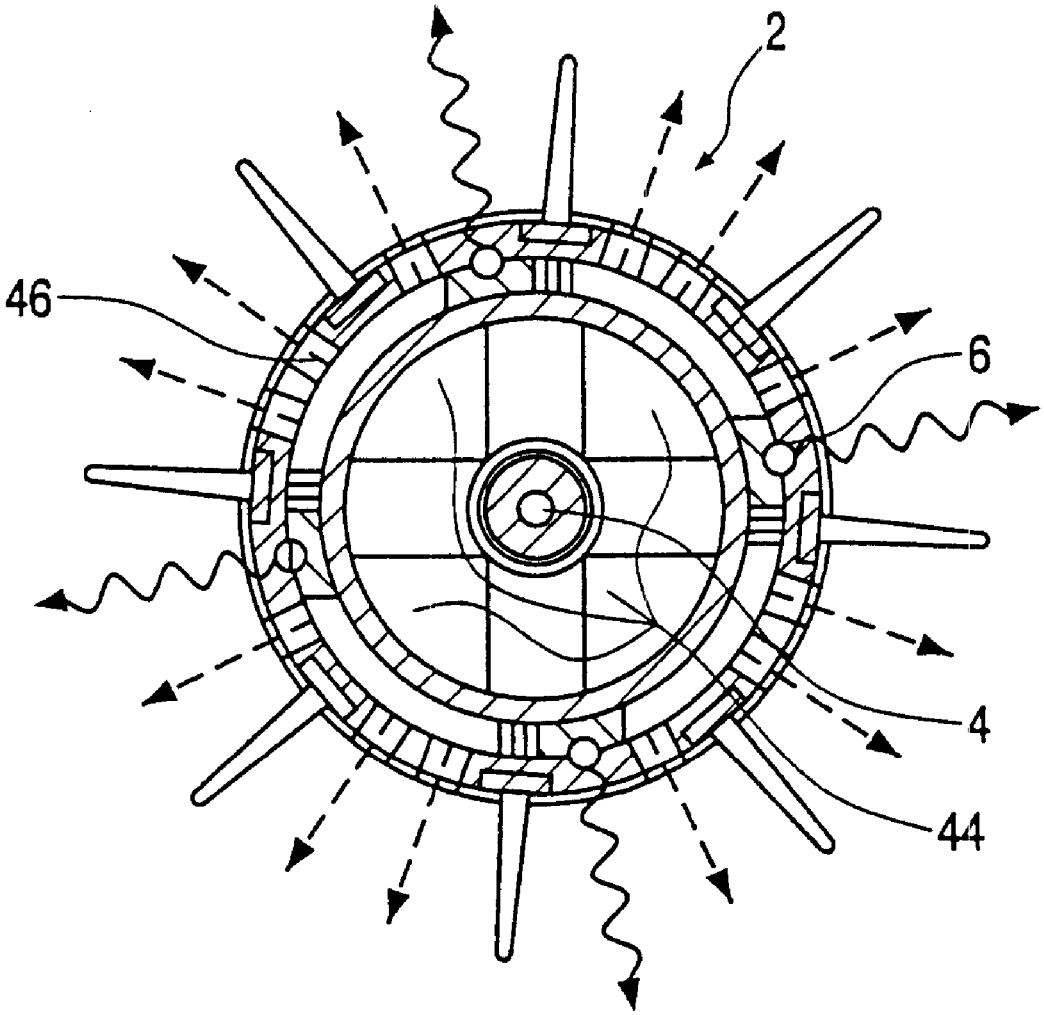
Figure 4A:
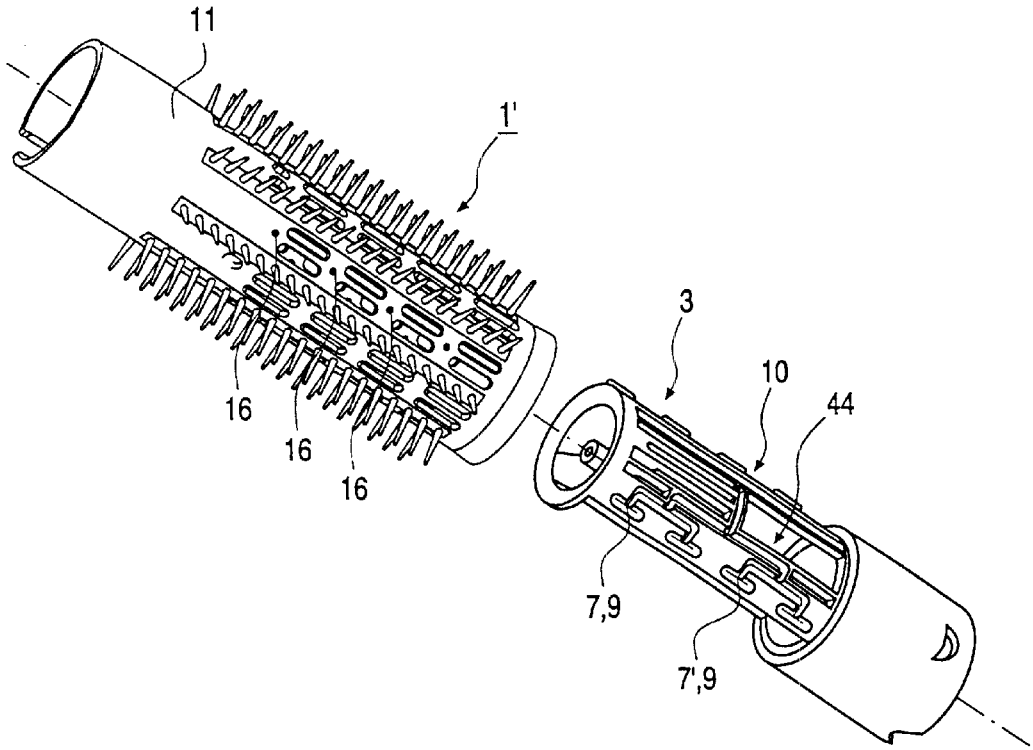
Figure 4B:
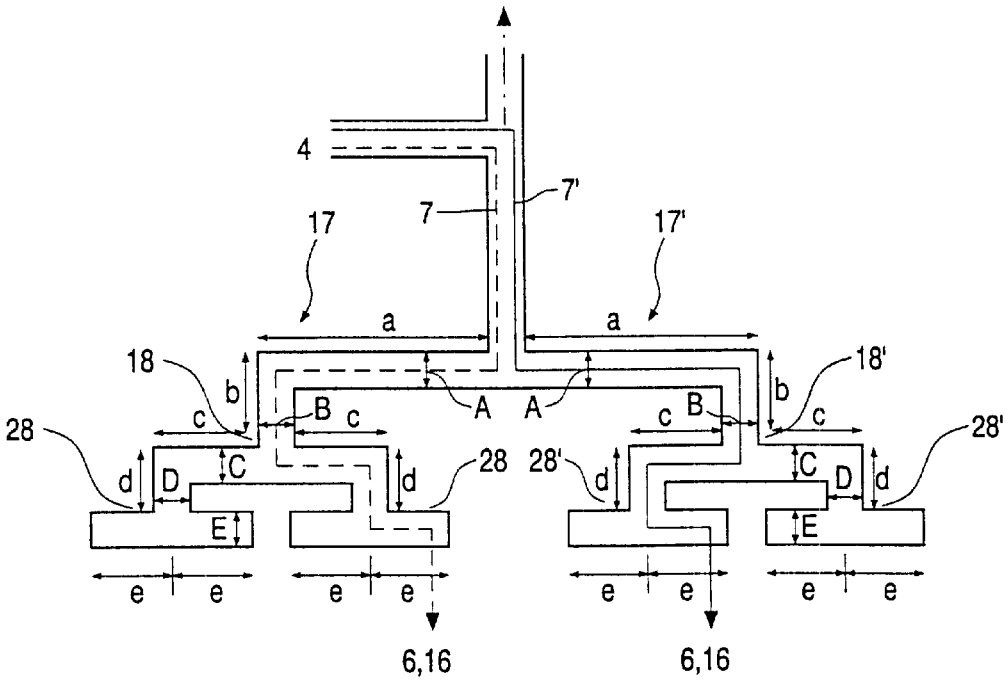
Figure 5:
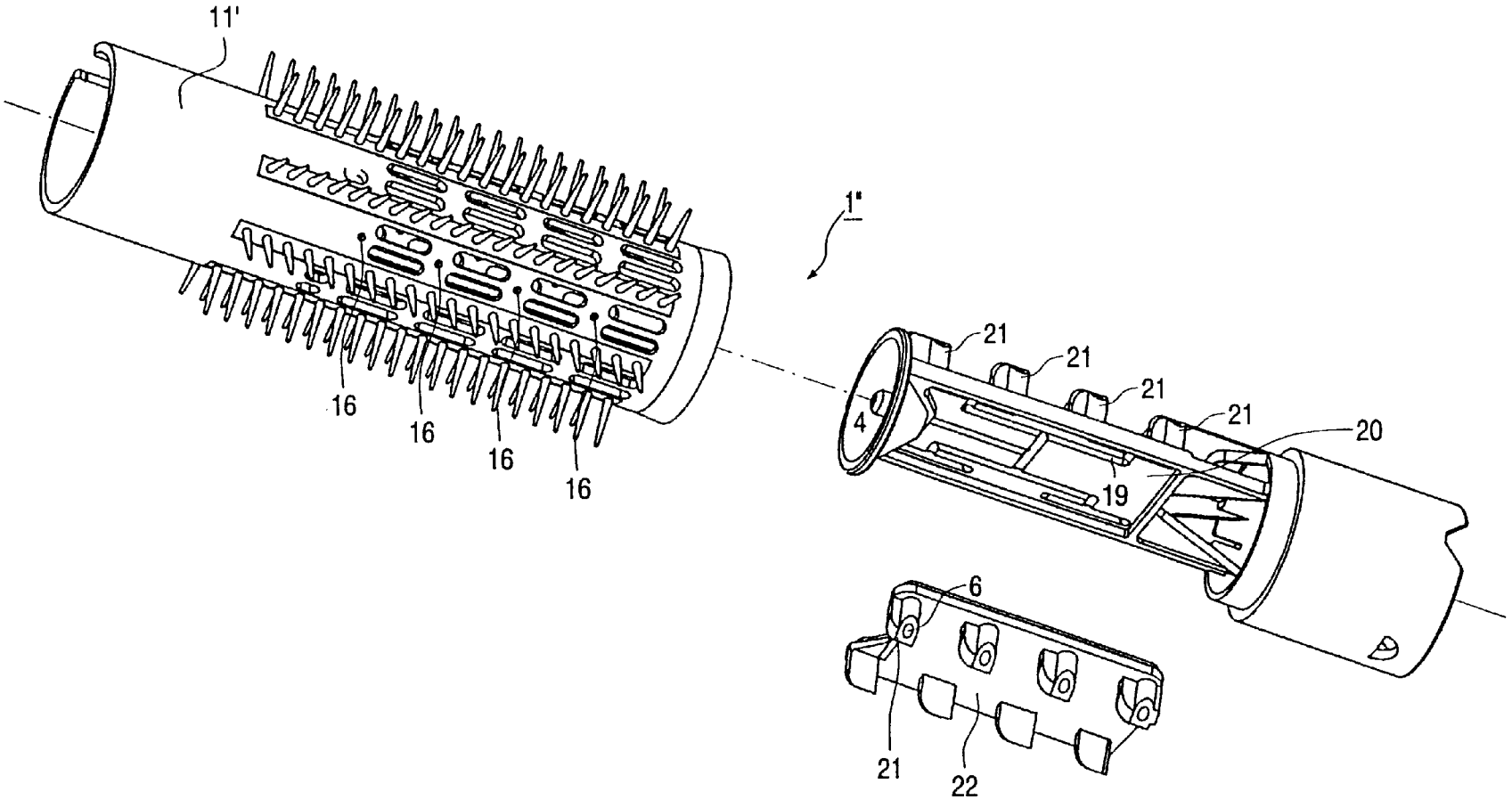
Figure 6A:
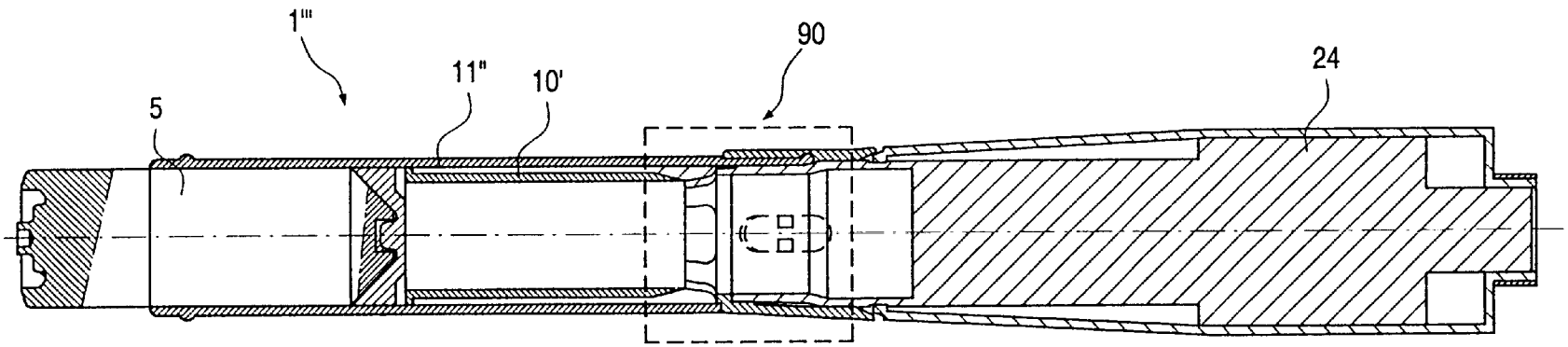
Figure 6B:
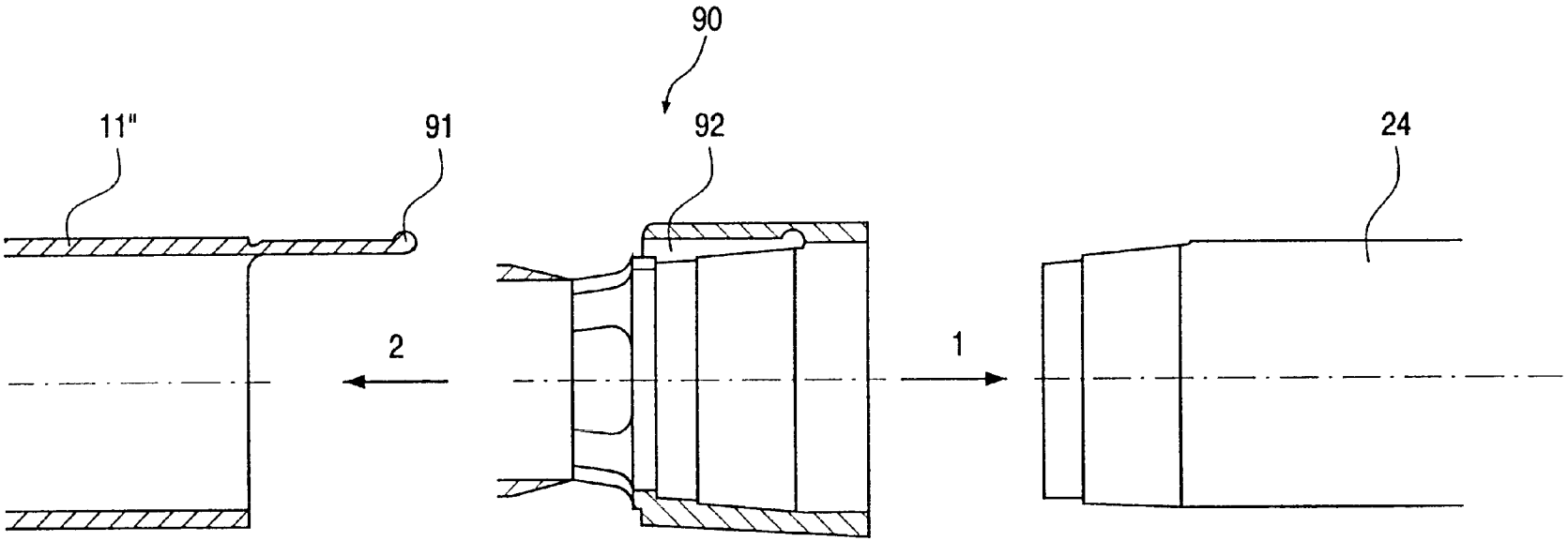

The invention will be described in more detail below with reference to the drawings, in which FIG. 1 is a diagrammatic side elevation of an electric hairstyler according to the invention comprising a first embodiment of a device for applying an additive to hair according to the invention, FIG. 2 is a diagrammatic cross-sectional view of the electric hairstyler taken on the line II—II in FIG. 1, FIG. 3 is a diagrammatic cross-sectional view of the electric hairstyler taken on the line III—III in FIG. 1, FIG. 4*a* is a perspective view of a carrier element and a covering element of a second embodiment of a device for applying an additive to hair according to the invention, FIG. 4*b* diagrammatically shows part of the carrier element of FIG. 4*a*, FIG. 5 is an exploded view of a carrier element and a covering element of a third embodiment of a device for applying an additive to hair according to the invention, FIG. 6*a* is a diagrammatic view of a detachable connection of a carrier element and a covering element of a fourth embodiment of a device for applying an additive to hair according to the invention with a handle of an electric hairstyler according to the invention, FIG. 6*b* shows part of the connection of FIG. 6*a* in detail.

FIGS. 1, 2 and 3 show a first embodiment of a device 1 for applying an additive to hair according to the invention, provided in an electric hairstyler 41 according to the invention. The device 1 comprises a longitudinally extending base part 2 for making contact with the hair during operation, the base part 2 comprising a distribution system 3 for additive. In this embodiment, the base part 2 is provided with brush pins 62 on its entire outer circumferential surface. However, variations in elements and areas on the base part where these elements are provided are possible. Brush pins may alternatively be provided on, for example, only one half of the outer circumferential surface of the base part 2, or brush hairs may be provided instead of pins. The distribution system 3 has an inlet 4 which is connected to an additive dispenser 5. The additive dispenser 5 in this embodiment contains a foam pump 51 and an additive container 52 which are schematically shown in FIG. 2. The additive dispenser 5 may be of a type which is known per se, depending on the additive to be used. The distribution system 3 further has outlets 6 for applying the additive to the hair during operation. A flow path 7, 7' is present between said inlet 4 and each outlet 6, which flow path comprises at least one ramification point 8. Said flow paths 7, 7' have a substantially identical flow resistance, measured from the inlet 4 to each outlet 6. When during operation a user activates the device by pressing on a button 53 on the additive dispenser 5, foam is created by the foam pump 51 within the additive dispenser 5 and is directed to the inlet 4. From the inlet 4, foam flows through a central tube 33 which ends in the ramification point 8. From this ramification point 8, foam flows along the branches 27, 27' of the flow paths 7 and 7' to each outlet 6. The foam is subject to a substantially identical flow resistance when flowing along these flow paths 7, 7' from the inlet 4 to each outlet 6. The foam thus reaches all outlets 6 practically simultaneously, and leaves said outlets 6 at substantially equal flowrates. This results in an even distribution of the foam over the hair, which benefits a good hairstyling result. The base part 2 furthermore has a first end 23 on which a handle 24 is provided and a second end 25 on which the additive dispenser 5 is provided. A user can hold the hairstyler by the handle 24 with one hand and bring the base part 2 easily into contact with the hair. Since the additive dispenser 5 is provided on the other end of the base part 2, the user still has easy access to the dispenser 5 for activating it by pressing the button 53 with the other hand. The additive dispenser 5 can thus also be easily detached from the base part 2, for example for replacement or refilling.

The electric hairstyler 41 further comprises power supply means 42. As can be seen in FIGS. 2 and 3, the handle 24 in this embodiment comprises a fan unit 43, and the base part 2 comprises air transport channels 44 extending from the handle 24 to air outlets 46 provided in the base part 2. The power supply means 42 and the fan unit 43 are of a type which is known per se and are shown diagrammatically only here. The hair can thus be treated by means of hot or cold air, which is distributed from the fan unit 43 through the air transport channels 44 over the air outlets 46 and is thus directed to the hair, as indicated in FIG. 3 by the dotted arrows, while at the same time the hair can be treated by means of the foam. This foam, indicated by the wrinkled arrows in FIG. 3, is evenly distributed over the hair. A good hairstyling result can be achieved in this manner. The order in which air and foam are applied may be varied, and the foam-applying function and the air-applying function can also be used individually with the electrical hairstyler 41.

As can be seen in FIG. 4*a* showing a second embodiment of a device 1' for applying an additive to hair according to the invention, the flow paths 7, 7' are provided as slots 9 on a cylindrical carrier element 10 which are covered by a cylindrical covering element 11. These slots 9 merge into openings 16, forming the outlets of the distribution system, in the covering element 11. The covering element 11 and the carrier element 10 are detachably connected to one another, which is further illustrated in FIG. 6 and its description. The covering element 11 can thus be detached from the carrier element 10 after use, and the parts can be cleaned to remove any foam residue. This benefits a proper flow of foam through the distribution system 3 during a next use of the device 1. FIG. 4*b* diagrammatically shows part of the carrier element 10 with the flow paths 7, 7' in a developed view. As can be seen, the flow paths 7 and 7', indicated respectively with a dotted line and a continuous line, and each and every other flow path between the inlet 4 and one of the respective openings 16, comprise an identical sequence of flow channels 17 and 17' and flow channel ramification points 18, 28, and 18', 28'. Corresponding flow channels 17 and 17' of said sequences have identical lengths a,b,c,d,e and cross sections A,B,C,D,E; and corresponding flow channel ramification points 18 and 18', and 28 and 28', of said sequences have an identical number of branches. This measure keeps the flow resistance of the flow paths 7, 7' substantially identical in a comparatively simple and reliable manner, while many modifications may be created in an easy and cost-effective manufacture. The construction can thus be adapted to, for example, the desired number and position of outlets. As can be seen in FIG. 4*a*, only one half of the circumferential area of the carrier element 10 is provided with slots 9 in this embodiment, which merge into openings 16 correspondingly positioned on the covering element 11. It is noted that the additive dispenser 5 in this embodiment is provided in the same way as in the preceding embodiment and is not further shown here.

FIG. 5 shows a carrier element 20 and a covering element 11' of a third embodiment of a device 1" for applying an additive to hair according to the invention. In this embodiment, the flow paths are provided as channels 19 provided in a longitudinally extending flat support 20. The channels 19 extend from the inlet 4 to hollow protuberances 21, which hollow protuberances 21 extend from a surface 22 of said support 20 to the outlets 6, the latter being formed by openings 16 in the covering element 11'. The covering element 11' in this embodiment also serves to accommodate hairstyling elements such as pins, and to provide air outlets to the hair, so that the device is suitable for use in an electric hairstyler with a fan unit. In this embodiment, the covering element 11' and the carrier element 20 are again detachably connected to one another.

It is noted that the second and the third embodiment of the device 1 for applying an additive to hair according to the invention, provided with the additive dispenser 5 as described above, may be used on its own, or in combination with an electric hairstyler. When the carrier element 10, 20 and the covering element 11, 11' are provided in an electrical hairstyler, the carrier element and the covering element are connected to the handle during operation. It is advantageous when these parts are detachable from the handle only while attached to each other.

FIG. 6*a* diagrammatically shows a detachable connection 90 of a carrier element 10' and a covering element 11" of a fourth embodiment of a device 1'" for applying an additive according to the invention, with the handle 24 of the electric hairstyler 41 according to the invention. The parts of the carrier element 10' and the covering element 11" related to the distribution of additive are shown diagrammatically. FIG. 6*b* shows a detail of the connection 90 enclosed in the dotted rectangle of FIG. 6*a*. The covering element 11" comprises a tongue 91 which fits in a slot 92 in the carrier element 10' and which is fastened in said slot 92 as long as the carrier element 10' is connected to the handle 24. Only after the handle 24 and the assembly of the carrier element 10' and the covering element 11" are separated, as indicated with arrow 1, can the covering element 11" be detached from the carrier element 10', as indicated with arrow 2. If one of the elements should stay attached to the handle after use, which accommodates the electrical components, the element connected to the handle could be exposed to liquid during cleaning with the handle still being plugged in. This would lead to a hazardous situation for the user. Since in this preferred embodiment these elements are detachable from one another only after detachment of both elements from the handle, both elements can be cleaned separately only after being detached from the handle, and a safe handling of the device is safeguarded thereby also after operation.

It is observed that additive originating from the inlet and following the flow paths to each outlet reaches all outlets practically simultaneously and with an equal flow rate during operation, because each flow path has a substantially identical flow resistance from the inlet to each outlet in a device for applying an additive to hair according to the invention. As a result of this the additive is distributed evenly over the hair by the device, which benefits a good hairstyling result. It is noted that the substantially identical flow resistance of the flow paths can be obtained in various ways. The flow paths may be given mutually differing lengths, cross sections and numbers of ramification points, as long as the resulting flow resistances of the flow paths from the inlet to each outlet stay substantially identical.

It is furthermore observed that the device for applying an additive to hair according to the invention is especially suitable for the even distribution of foam over the hair. However, said device is also suitable for an even distribution of other additives over the hair, for example hair lotion, hair tonic or hair conditioner. Also hair dyes, for which an even distribution over the hair is essential to achieve an optimal coloring effect on the hair, may be distributed advantageously over the hair with the device for applying an additive to hair according to the invention.

What is claimed is:

1. A device for applying an additive to hair, comprising a longitudinally extending base part for making contact with the hair during operation, which base part comprises a distribution system for additive;

which distribution system has an inlet which is connected to an additive dispenser and has outlets for applying the additive to the hair during operation;

flow paths being present between the inlet and the outlet, which flow paths comprise at least one ramification point, said flow paths having a substantially identical flow resistance, measured from the inlet to each outlet, characterized in that the flow paths comprise an identical sequence of flow channels and flow channel ramification points, corresponding flow channels of said sequences having identical lengths and cross sections, and corresponding flow channel ramification points of said sequences having an identical number of branches.

2. A device for applying an additive to hair as claimed in claim 1, characterized in that the flow paths are provided as slots on a cylindrical carrier element which are covered by a cylindrical covering element and which merge into openings in the covering element.

3. A device for applying an additive to hair as claimed in claim 2, characterized in that the carrier element and the covering element are detachably connected to each other.

4. A device for applying an additive to hair as claimed in claim 1, characterized in that the flow paths are provided as channels provided in a longitudinally extending flat support, which channels extend from the inlet to hollow protuberances, which hollow protuberances extend from a surface of said support to the outlets.

5. A device for applying an additive to hair as claimed in claim 1, characterized in that the base part has a first end on which a handle is provided and a second end on which the additive dispenser is provided.

6. An electric hairstyler comprising power supply means and a handle and comprising a device for applying an additive to hair, which device comprises a longitudinally extending base part for making contact with the hair during operation, which base part comprises a distribution system for additive, which distribution system has an inlet which is connected to an additive dispenser and has outlets for applying the additive to the hair during operation, characterized in that said device for applying an additive to hair is a device as claimed in claim 1.

7. An electric hairstyler as claimed in claim 6, comprising a device for applying an additive to hair as claimed in claim 3, characterized in that the carrier element and the covering element are connected to the handle during operation and are detachable from the handle only while attached to each other.

8. An electric hairstyler as claimed in claim 6, characterized in that the handle comprises a fan unit, and the base part comprises air transport channels extending from the handle to air outlets provided in the base part.

9. An electric hairstyler as claimed in claim 7, characterized in that the covering element comprises a tongue which fits in a slot in the carrier element and which is fastened in said slot as long as the carrier element is connected to the handle.

* * * * *